United States Patent [19]

Kitchen

[11] 4,440,368

[45] Apr. 3, 1984

[54] MOUNTING SYSTEM FOR PANEL MOUNTED DEVICES

[75] Inventor: Robert D. Kitchen, Freeport, Ill.

[73] Assignee: Honeywell Inc., Minneapolis, Minn.

[21] Appl. No.: 261,359

[22] Filed: May 7, 1981

[51] Int. Cl.[3] ..... G12B 9/00

[52] U.S. Cl. ..... 248/27.1; 248/56

[58] Field of Search ..... 248/27.1, 27.3, 56, 248/57

[56] References Cited

U.S. PATENT DOCUMENTS

| | | | |
|---|---|---|---|
| 3,146,010 | 8/1964 | Dellith | 248/27.1 |
| 3,164,873 | 1/1965 | Marek | 248/27.3 |
| 3,599,910 | 8/1971 | Wipff | 248/27.1 |
| 3,611,266 | 10/1971 | Amis | 248/27.1 |
| 3,770,925 | 11/1973 | Nelson et al. | 248/27.1 |
| 4,363,461 | 12/1982 | Smejkal | 248/27.1 |

*Primary Examiner*—William H. Schultz
*Assistant Examiner*—Ramon O. Ramirez
*Attorney, Agent, or Firm*—Charles L. Rubow

[57] ABSTRACT

A quick mounting system for panel mounted devices is disclosed in which a front mounting flange carries captive screw means which cooperates with thread engagement means in a base to be mounted on the back of the panel. The thread engagement means comprises a resilient wire form having at least one leg positioned and biased to engage the threads. A ramp surface in the base permits the leg to be deflected by linear insertion force on the screw means, but prevents withdrawal thereof except by rotation.

12 Claims, 4 Drawing Figures

MOUNTING SYSTEM FOR PANEL MOUNTED DEVICES

BACKGROUND OF THE INVENTION

The invention disclosed herein relates generally to mounting arrangements for panel mounted apparatus, and more particularly an easily demountable quick mounting system for panel mounted switches, indicators and similar devices.

Panel mounted electrical switches, indicators, and similar devices have long been a part of many types of industrial equipment. A considerable number of designs, techniques and arrangements have been devised accomplishing the mounting function. However, the evolution of industrial equipment has led to the use of switches and indicators in increasingly large numbers, and has placed increasing emphasis on appearance and ease of installation and removal.

For appearance the mounting should be usable with a variety of device trim configurations, including square low profile caps and trim elements. For ease of installation and removal, it is desirable that any required tools be limited to simple commonly available tools useable in limited space and requiring no more than moderate force and convenient motions, and that installation or removal be accomplished primarily from the front of the panel. It is also desirable that the mounting arrangement be self-contained, i.e., that it not require the use of loose parts, such as spacers, shims, gaskets, screws or other fasteners which are easily separated from the principal parts of the device. Finally, the mounting arrangement should readily accommodate a range of panel thicknesses. Compensation for different panel thicknesses should be provided on the back side of the panel to provide uniform front projection. The back side projection should also be constant regardless of panel thickness.

Concurrently, it is necessary to retain the features of durability and secure mounting. The mounting must be secure for both linear and rotary motions to accommodate switches having either type of operator. The durability and secure mounting requirement dictates at least a "semi-hard" mount.

A common conventional form of mounting arrangement comprises a threaded barrel which extends through an opening in the panel. A nut is mated with the barrel and tightened against the front surface of the panel. Such an arrangement is well adapted to provide a secure hard mount. However, it generally does not result in a uniform front projection with panels of different thicknesses unless a second nut or appropriate spacers are selected and placed on the barrel behind the panel. Further, such an arrangement is typically used with a circular knob, button or lens as shown in U.S. Pat. No. 2,734,953.

U.S. Pat. No. 3,264,527 issued to J. Fitzsimmons on Aug. 2, 1966 discloses a "semi-hard" switch mounting arrangement for square or rectangular switch housings. The mounting arrangement comprises a series of ridges and intervening valleys on at least one side of a rear portion of the switch housing. The ridges cooperate with a square or rectangular mounting sleeve having inwardly inclined tabs which engage the ridges as the sleeve is slipped over the switch housing. The sleeve is equipped with springs which bear on the back of the mounting panel so as to provide a firm mount even in a panel whose thickness corresponds to a tab location between valleys. Removal requires lifting of the tabs out of the valleys. Such an arrangement adequately accommodates panels of different thicknesses and installation is done predominantly from the front of the panel. However, such an arrangement has the disadvantage of requiring removal to be done from the back of the panel where the tabs on the mounting sleeve are accessible. In addition, such a device design generally requires a square or rectangular hole in the panel which, for various reasons, is less desirable than a round hole.

U.S. Pat. No. 3,446,467 issued to J. Bailey, et al., on May 27, 1969 discloses a mounting arrangement in which a switch body is configured with serrated side portions over which are fitted mounting clips having mating serrations which permit the clips to be installed in several discrete fore-aft positions to accommodate panels of different thicknesses. The clips are formed with outwardly inclined tabs for engaging the back of a mounting panel. Installation is done from the front of the panel by pushing the switch body-clip assembly through a mounting hole which depresses the tabs on the clips until they pass through the hole, at which time they spring outwardly to lock the switch in place. Such an arrangement generally does not provide a particularly secure mount and removal can only be accomplished from the rear of the panel. In addition, this configuration is primarily adapted to square or rectangular mounting holes.

U.S. Pat. No. 3,770,925 issued to T. Nelson, et al., on Nov. 6, 1973 discloses a switch mounting arrangement in which a front housing contains captive fasteners having cams which engage depressions in a barrel portion of the switch body which extends through the panel. In this arrangement, installation and removal can be accomplished from the front of the panel. However, appropriate bushings or gaskets, determined by mounting panel thickness, must be selected and placed over the barrel portion of the body during installation.

The applicant's mounting system design avoids or minimizes the previously noted shortcomings of prior mounting arrangements by utilizing captive threaded fastener means which mate with special thread engagement means capable of permitting insertion with simple linear force, but requiring rotation of the threaded fasteners for removal. Semi-hard mounting and automatic compensation for panel thickness is achieved. Installation and removal are both simply accomplished from the front of the panel without the use of special tools.

SUMMARY OF THE INVENTION

The present invention is a quick mounting system for panel mounted devices. The system includes a base and a front mounting flange which clamp together on opposite sides of a mounting panel. Captive screw means in the mounting flange mates with thread engagement means in the base comprising a deflectable member positioned and biased to engage threads on the screw means and a ramp surface which prevents the deflectable member from being deflected out of the threads in response to forces tending to pull the screw means from the base. Specifically, the ramp surface extends away from the panel and is inclined away from the axis of the screw means with distance from the panel. The deflectable member may be a resilient generally U-shaped wire form having parallel legs which engage the threads on opposite sides of the screw means, with each leg cooperating with a separate ramp surface in the base. The base may include a captive spring-loaded plate and gasket for achieving oil tight installation in panels having a range of thicknesses without the need for spacers, extra gaskets or loose parts.

DESCRIPTION OF THE PREFERRED EMBODIMENT

Figure 1:
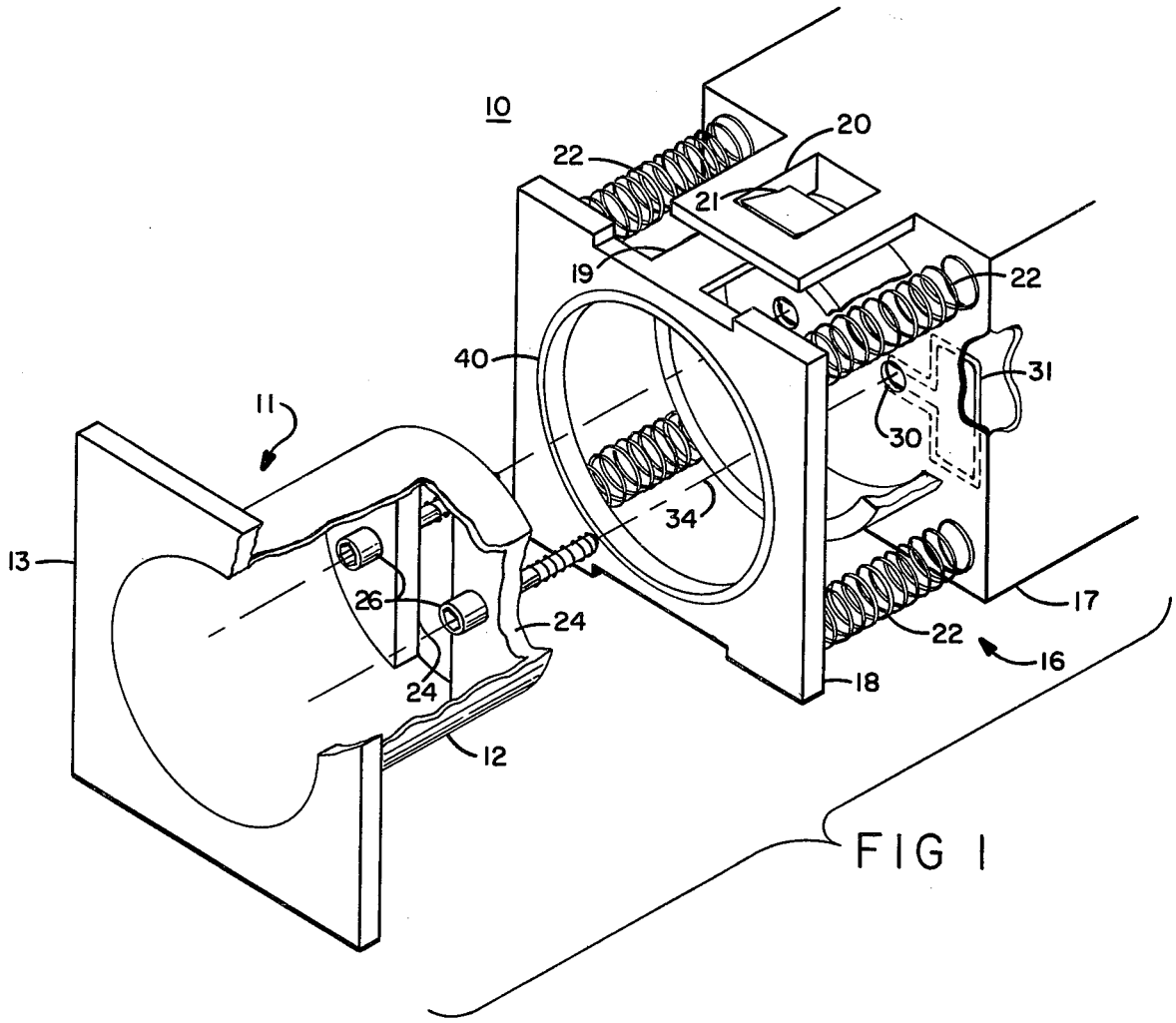
FIG. 1 is a partial exploded isometric view of a panel mounted device including a mounting arrangement in accordance with the applicant's invention.

In FIG. 1, reference numeral 10 generally identifies a device, such as an electrical switch or indicator intended for panel mounting. Device 10 includes a mounting flange or flange member 11 having a tubular extension or barrel 12 which extends through a hole in a panel in which the device is to be mounted. Barrel 12 is preferably round in cross-section to fit a round hole in the panel. Mounting flange 11 also includes a faceplate 13 exposed on the front of the panel. Faceplate 13 is shown as square and having a low profile, and is designed to accommodate a variety of linear or rotary switch actuators or indicators (not shown).

Mounting flange 11 cooperates with a base generally identified by reference numeral 16 positioned on the opposite side of the panel from the mounting flange. Base 16 includes a housing 17 carrying a captive pressure plate 18. Attachment of pressure plate 18 to housing 17 is accomplished by means of a stirrup and hook arrangement, including a pair of rectangular projections (only one shown) 19 extending rearwardly from pressure plate 18. Projection 19 slides into a channel in housing 17. The outer wall of the channel has a rectangular opening 20 therein which forms a stirrup. The stirrup engages a hook 21 on the end of projection 19. Accordingly, pressure plate 18 is permitted to move relative to housing 17 but is prevented from separating therefrom by the hook and stirrup arrangement. A plurality of compression springs 22 are provided between housing 17 and pressure plate 18 for purposes which will hereinafter be described.

Figure 2:
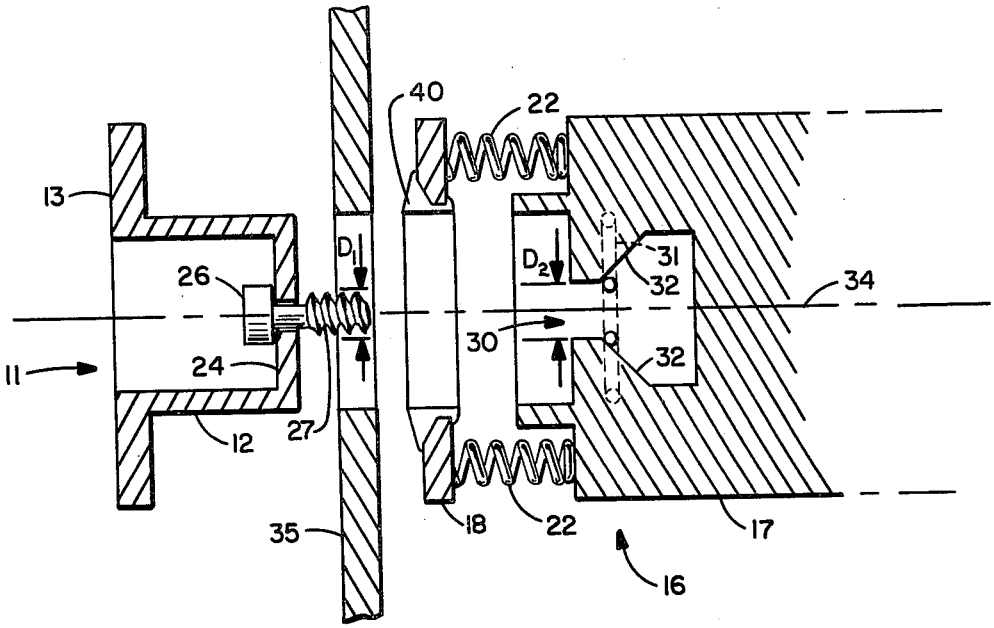
FIG. 2 is a schematic diagram illustrating the principal components of the applicant's mounting arrangement in block form and disassembled.
Figure 3:
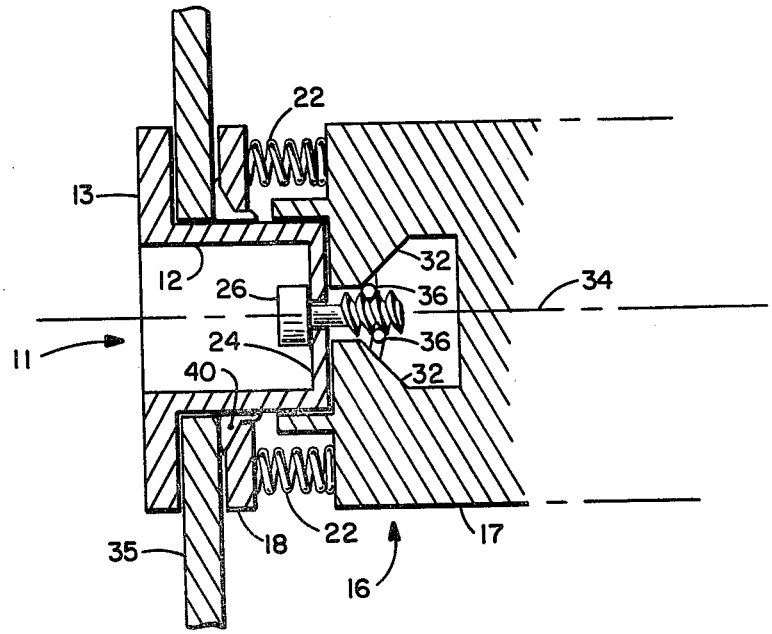
FIG. 3 is a schematic diagram illustrating the principal components of the applicant's invention in block form and installed in a panel.

The end of barrel 12 remote from faceplate 13 is partially closed by means of a member 24 having a pair of captive threaded fasteners of screw means 26 protruding therethrough. As illustrated in FIGS. 2 and 3, in which elements corresponding to those shown in FIG. 1 are identified by the same reference numerals as in FIG. 1, threaded fasteners 26 each include a threaded shank 27 having a major diameter $D_1$.

Fasteners 26 may be inserted into a pair of holes or apertures 30 in housing 17 where the threads of the fasteners are engaged by resilient generally U-shaped wire forms 31, of which one is shown partially in dotted lines in FIGS. 1 and 2. Each wire form 31 cooperates with a pair of inclined surfaces 32 (see FIGS. 2 and 3) of an aperture 30, as will hereinafter be described, to achieve especially advantageous installation and removal characteristics for the applicant's mounting system.

For purposes of describing the operation of the thread engagement means comprising wire form 31 and inclined surfaces 32, it is assumed that fastener 26 extends along an axis 34 transverse to a panel 35 in which device 10 is to be mounted. Fastener 26 extends along axis 34 in a first direction toward base 16. Aperture 30 in housing 17 also extends along axis 34 and has a minimum diameter $D_2$ slightly greater than major diameter $D_1$ of the fastener. Inclined surfaces 32 which are formed in the walls of aperture 30 are configured so that the distance of the surfaces from axis 34 increases with the distance along the axis from mounting flange 11.

Figure 4:
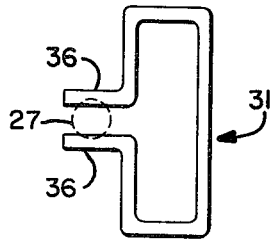
FIG. 4 is an illustration of a preferred embodiment of a resilient wire form thread engagement element used in the mounting system illustrated in FIGS. 1–3.

Generally U-shaped resilient wire form 31, which can best be seen in FIG. 4, includes a pair of legs each having a terminal portion 36 which is offset from the remaining portion of the leg. The offsets are toward axis 34. Terminal portions 36 are generally parallel and are spaced apart a distance approximately equal to the minor diameter of the threads of shank 27. The offsets facilitate deflection of the terminal portions of the legs as will hereinafter be described.

Wire form 31 is held in housing 17 in such a manner that terminal portions 36 are permitted to deflect along axis 34 in a direction away from mounting flange 11. Deflection along axis 34 is accompanied by deflection away from the axis. However, in their relaxed state, terminal portions 36 rest against ramp surfaces 32 proximate the area of minimum dimension or minimum diameter of aperture 30. Accordingly, ramp surfaces 32 prevent deflection of terminal portions 36 in a direction toward mounting flange 11, and also prevent deflection of terminal portions 36 away from axis 34 when force is applied to the portions in a direction toward mounting flange 11. Thus, fastener 26 may be inserted into aperture 30 between terminal portions 36 simply by applying a linear force to the fastener along axis 34. However, fastener 26 can only be withdrawn from housing 11 by rotating it about axis 34.

In FIG. 3 flange 11 and base 16 are shown installed in panel 35. Installation is accomplished by holding base 16 against the panel at the location of the installation hole and inserting barrel 12 of the mounting flange through the hole and into the base. The mounting flange and base are then pressed together, thus compressing springs 22. Since fastener 26 is captive in mounting flange 11, its threaded shank 27 is pushed between terminal portions 36 of wire form 31. This causes the legs of the wire form to be deflected so that the threaded shank passes between them. As this passage occurs terminal portions 36 snap into valleys in the threads. When flange 11 and base 16 are released, terminal portions 36 are prevented from spreading by ramp surfaces 32, thus securing the mounting flange and base together.

Pressure plate 18 is pressed against panel 35 by springs 22. A resilient seal or gasket 40 is fitted around the perimeter of the aperture through pressure plate 18. This aperture is configured with a sloped surface to direct the seal toward both panel 35 and barrel 12. By virtue of the force on pressure plate 18 provided by springs 22, gasket 40 is caused to seat against both the barrel and the panel, thus providing an oil tight seal. The complete installation is made oil tight by providing an O-ring or other suitable gasket between the inside of barrel 12 and switch operator or indicator components (not shown) that fit within the barrel.

Barrel 12 is designed with a length such that, as the mounting flange and base are pressed together, the bottom of the barrel contacts housing 17 before pressure plate 18 contacts the housing. Accordingly, the advantages of a "semi-hard" mount are provided.

Although fastener 26 may not be withdrawn from base 16 by force along axis 34, it may be withdrawn by rotation about the axis so as to turn the threaded shank 27 out from between terminal portions 36. As shown in FIG. 1, fasteners 26 are provided with heads designed for a standard hex key to facilitate rotation when desired. Accordingly, a device embodying the applicant's mounting system may be easily demounted, and such demounting may be done from the front of the panel.

In accordance with the foregoing description, the applicant has provided a unique quick mounting system for panel mounted devices which offers the advantages of semi-hard mounting without the necessity of tools. Mounting can be accomplished predominantly from the front of the panel. The mounting system accommodates a range of panel thicknesses without the need for loose spacers, shims or bushings, and provides for a uniform projection on the front and back of the panel. Finally, removal is easily accomplished with simple common tools, predominantly from the front of the panel.

Although a particular embodiment has been shown and described for illustrative purposes, a number of variations and modifications will be apparent to those familiar with the relevant arts. It is intended that coverage of the invention not be limited to the embodiment shown, but only by the terms of the following claims:

The embodiments of the invention in which an exclusive property or right is claimed are defined as follows:

1. A quick mounting system for panel mounted devices comprising:

a base to be mounted on a panel;

a mounting flange cooperating with said base to provide for clamping the panel between said base and said mounting flange;

screw means captive in said mounting flange and having a threaded shank with a given major diameter extending from said mounting flange in a first direction toward said base along an axis transverse to the panel at the mounting location;

thread engagement means in said base having a deflectable member configured and biased to engage at least a portion of the threads of said screw means and a ramp surface cooperating with the deflectable member to permit deflection thereof away from the axis in response to a force in the first direction and to prevent deflection away from the axis in response to a force in a direction opposite the first direction.

2. The mounting system of claim 1 wherein said thread engagement means comprises:

an aperture in said base having a minimum dimension perpendicular to the axis greater than the major diameter of the threaded shank, said aperture extending along the axis and being configured to form the ramp surface whose distance from the axis increases with distance from said mounting flange; and biasing means for biasing the deflectable member to a position adjacent the ramp surface proximate the area of minimum dimension of said aperture.

3. The mounting system of claim 2 wherein:

said aperture includes ramp surfaces on opposite sides of the axis, each ramp surface being configured so that its distance from the axis increases with distance from said mounting flange; and said biasing means and deflectable member comprise portions of a generally U-shaped resilient wire form having a pair of legs extending transverse to the axis on opposite sides thereof, each positioned adjacent a separate ramp surface proximate the area of minimum dimension of said aperture.

4. The mounting system of claim 1 or 3 wherein said base includes:

a captive plate on the side of the base toward said mounting flange and movable along the axis relative to the remainder of said base; and spring means for biasing said plate toward said mounting flange, whereby the force with which a panel is clamped between said mounting flange and said plate is supplied by said spring means.

5. The mounting system of claim 4 wherein:

said mounting flange includes a barrel portion which extends through the panel;

said captive plate has an aperture therethrough into which the barrel portion of said mounting flange extends; and a sealing gasket is provided at the aperture of said captive plate, the aperture in said captive plate and said sealing gasket being configured to seat said sealing gasket against the panel and the barrel portion of said mounting flange.

6. A quick mounting arrangement for panel mounted devices comprising:

a flange member to be located on a first surface of a panel;

a base to be located on a second surface of the panel opposite the first surface, said base cooperating with said flange member to provide for clamping the panel therebetween;

screw means having a threaded shank with major and minor diameters, said screw means being captive in said flange member and extending in a first direction toward said base along an axis transverse to the plane of the panel at the mounting location;

an aperture in said base extending along the axis, said aperture having a minimum dimension perpendicular to said axis greater than the major diameter of the shank of said screw means, at least one surface of said aperture being inclined away from the axis with distance along the axis in the first direction; and a wire form attached to said base and having at least one deflectable leg directed transverse to the axis, the leg being configured and biased to engage the threads on said screw means, and positioned adjacent the inclined surface of said aperture proximate the area of minimum dimension, the leg being deflectable away from the axis when subjected to a force along the axis in the first direction and being restrained by the inclined surface from deflection away from the axis when subjected to a force along the axis in a direction opposite the first direction, whereby insertion of said screw means into said base requires only linear force along the axis and withdrawal requires rotation about the axis.

7. The mounting arrangement of claim 6 wherein:

said aperture defines a pair of opposing inclined surfaces on opposite sides of the axis; and said wire form is in a generally U-shaped configuration having a pair of deflectable legs directed transverse to the axis, each leg having a terminal portion adjacent a separate one of the inclined surfaces proximate the area of minimum dimension of said aperture, the terminal portions normally being spaced apart by a distance approximately equal to the minor diameter of the threaded shank.

8. The mounting arrangement of claim 7 wherein the U-shaped wire form is configured and located so that said screw means is engaged between the terminal portions of the legs and the terminal portions of the legs are offset toward the axis from the remaining portions of the legs to facilitate deflection of the terminal portions in the first direction and away from the axis.

9. The mounting arrangement of claim 6 or 8 wherein said base includes:

a pressure plate on the side of said base toward said flange member and movable along the axis relative to the remainder of said base;

spring means urging said pressure plate away from the remainder of said base; and means for holding said pressure plate captive to the remainder of said base while permitting limited movement therebetween.

10. The mounting arrangement of claim 9 wherein:

said pressure plate has an aperture therethrough;

said flange member includes a barrel portion which extends through the panel and into the aperture in said pressure plate; and the aperture in said pressure plate is fitted with an annular resilient gasket which seats against the panel and the barrel portion of said flange member to provide an oil tight seal.

11. A support system for mounting a device in a panel comprising:

flange means to be located on a first side of a panel;

captive screw means extending through said flange means along an axis transverse to a first major surface of the panel;

a base to be located on a second major surface of the panel opposite the first major surface and extending therefrom along the axis, said base having an aperture therein into which said screw means may pass, the aperture including a ramp surface extending away from the panel and inclined away from the axis with distance from the panel; and a wire form having at least one deflectable leg thereon, said wire form being held captive in said base so that at least a portion of the leg is exposed through the aperture, the leg being biased to engage threads on said screw means, but deflectable transverse to the axis when the screw means is inserted into the aperture, the leg cooperating with the ramp surface so that the leg is restrained from deflection out of engagement with the threads in response to forces tending to pull the screw means from the aperture, whereby clamping said flange means and said base on opposite sides of the panel may be accomplished by pressing said flange means and said base together so that said screw means is inserted into the aperture, and removal may be accomplished by rotating said screw means about the axis.

12. The support system of claim 11 wherein:

said wire form has a pair of substantially parallel deflectable legs positioned on opposite sides of the axis and sized, spaced and biased to engage the threads on said screw means; and the aperture in said base includes a pair of opposing ramp surfaces on opposite sides of the axis, the ramp surfaces being inclined away from the axis with distance from the panel, each ramp surface cooperating with a separate leg of said wire form.

* * * * *